US010557617B2

(12) United States Patent
D'Amico et al.

(10) Patent No.: US 10,557,617 B2
(45) Date of Patent: Feb. 11, 2020

(54) AUTO ALIGNING MODULE FOR LIGHTING APPLICATION

(71) Applicant: Current Lighting Solutions, LLC, East Cleveland, OH (US)

(72) Inventors: Bruno D'Amico, Lachine (CA); Alin Petrescu, Lachine (CA)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 170 days.

(21) Appl. No.: 15/215,629

(22) Filed: Jul. 21, 2016

(65) Prior Publication Data

US 2018/0023786 A1 Jan. 25, 2018

(51) Int. Cl.

| | |
|---|---|
| ***F21V 15/04*** | (2006.01) |
| ***F21K 9/235*** | (2016.01) |
| ***F21K 9/237*** | (2016.01) |
| ***B61L 9/04*** | (2006.01) |
| ***F21V 21/26*** | (2006.01) |
| *F21W 131/10* | (2006.01) |
| *F21Y 115/10* | (2016.01) |
| *F21W 111/00* | (2006.01) |
| *G08G 1/095* | (2006.01) |

(52) U.S. Cl.

CPC ..... *F21V 15/04* (2013.01); *B61L 9/04* (2013.01); *F21K 9/235* (2016.08); *F21K 9/237* (2016.08); *F21V 21/26* (2013.01); *F21W 2111/00* (2013.01); *F21W 2131/10* (2013.01); *F21Y 2115/10* (2016.08); *G08G 1/095* (2013.01)

(58) Field of Classification Search

CPC ..... F21V 15/04; F21V 21/26; F21K 9/235; B61L 9/04

See application file for complete search history.

(56) References Cited

U.S. PATENT DOCUMENTS

| | | | | |
|---|---|---|---|---|
| 4,345,301 A * | 8/1982 | Nelson | G01N 27/225 | 361/286 |
| 4,345,307 A * | 8/1982 | Mayer | B60Q 1/0683 | 362/306 |
| 5,099,401 A * | 3/1992 | Kondo | B60Q 1/2696 | 362/240 |
| 5,207,747 A * | 5/1993 | Gordin | F21V 21/30 | 362/233 |
| 6,036,336 A | 3/2000 | Wu | | |

(Continued)

FOREIGN PATENT DOCUMENTS

| | | |
|---|---|---|
| CN | 103883986 B | 2/2016 |
| KR | 101013694 B1 | 2/2011 |
| WO | 2015/136542 A1 | 9/2015 |

OTHER PUBLICATIONS

Extended European Search Report and Opinion issued in connection with corresponding EP Application No. 17181030.2 dated Sep. 20, 2017.

*Primary Examiner* — Anabel Ton

(74) *Attorney, Agent, or Firm* — Buckley, Maschoff & Talwalkar LLC

(57) ABSTRACT

A housing, an LED system, and an alignment module supported in the housing to mount the LED system in an interior space in the housing, dampen vibration(s) of the LED system in the interior space, and automatically align a focal point of the LED system. Such a lightening system may be applicable for a traffic/rail signal.

9 Claims, 5 Drawing Sheets

(56) References Cited

U.S. PATENT DOCUMENTS

| | | | | |
|---|---|---|---|---|
| 6,911,915 | B2 | 6/2005 | Wu et al. | |
| 9,784,440 | B2 * | 10/2017 | Erdener | F21V 21/26 |
| 2005/0030754 | A1 | 2/2005 | Licht | |
| 2008/0089070 | A1 * | 4/2008 | Wang | F21S 8/086<br>362/294 |

* cited by examiner

AUTO ALIGNING MODULE FOR LIGHTING APPLICATION

TECHNICAL FIELD

Embodiments generally relate to a lighting system including a housing, an LED system, and an alignment module supported in the housing to mount the LED system in an interior space in the housing, dampen vibration(s) of the LED system in the interior space, and automatically align a focal point of the LED system. Such a lightening system, for example, may be applicable for a traffic/rail signal.

BACKGROUND

In current incandescent traffic/rail signaling, in an interior space of the incandescent traffic/rail signal housing, an incandescent bulb is mechanically held in place by a socket base.

When retrofitting the current incandescent traffic/rail signal housing to utilize light-emitting diode (LED) technology, the socket base is not suitable for anchoring the LED system (LED source and PSU). LED systems require additional anchorage points that are not available in these housing making retrofit applications challenging.

BRIEF DESCRIPTION OF THE DRAWINGS

The various advantages of embodiments will become apparent to one skilled in the art by reading the following specification and appended claims, and by referencing the following drawings, in which:

DETAILED DESCRIPTION

Figure 1:
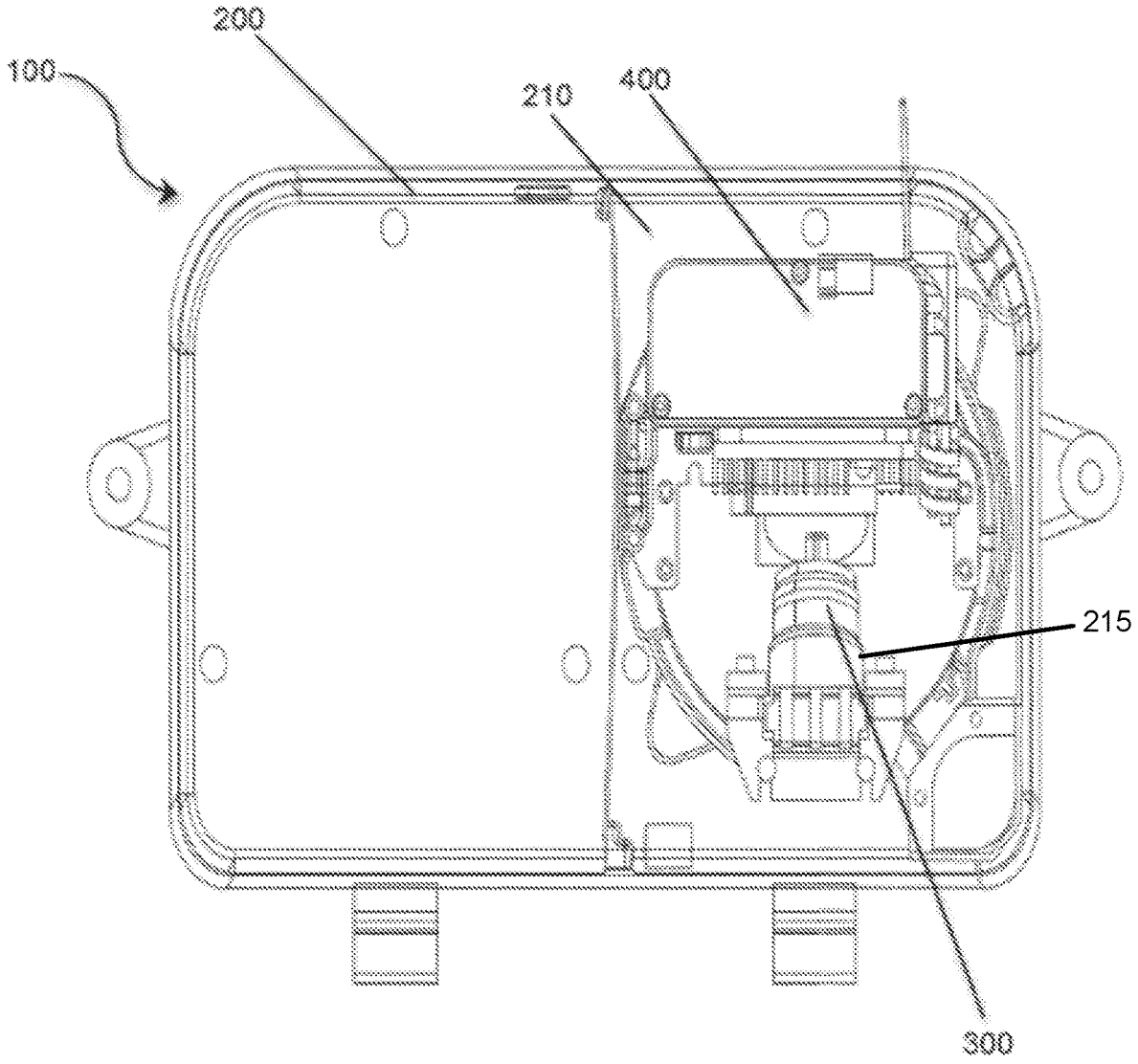
FIG. 1 illustrates a back view of a lighting system, in accordance with embodiments.
Figure 2:
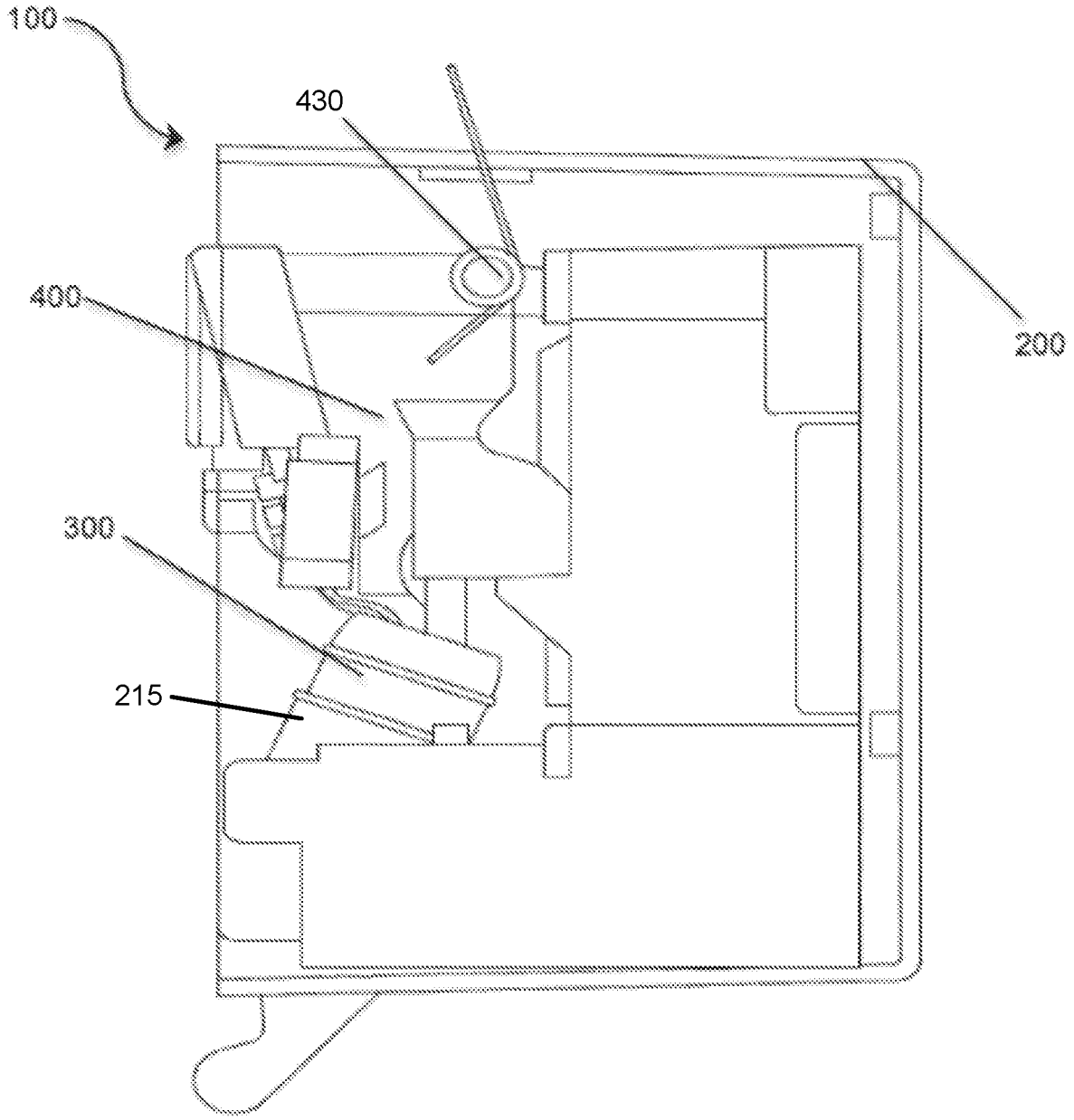
FIG. 2 illustrates a side view of the lighting system, in accordance with embodiments.

As illustrated in FIGS. 1 through 5, a lighting system 100 in accordance with embodiments includes a housing 200, an LED system 300 mounted in the housing 200, and an alignment module 400 supported in the housing 200 to mount the LED system 300 in the housing 200, dampen vibration of the LED system in the interior space, and automatically align a focal point of the LED system. Such a lightening system 100, for example, may be applicable for a traffic/rail signal.

The housing 200 defines an interior space 210 which is to receive the LED system 300 and the alignment module 400. As illustrated in FIGS. 1, 2, 4, and 5, the housing 200 may be utilized as a housing for a traffic/rail signal. Embodiment, however, are not limited thereto. The housing 200 may be for other industrial and/or domestic applications. While the housing 200 and the interior space 210 thereof are illustrated here having a specific structural geometry, embodiments are not limited thereto. In accordance with embodiments, the housing 200 and the interior space 210 thereof may be configured in any manner that permits practice of embodiments set forth herein.

The LED system 300 may comprise a conventional configuration that includes an LED module comprising an LED lamp having one or more LEDs connected to a power supply.

Figure 3:
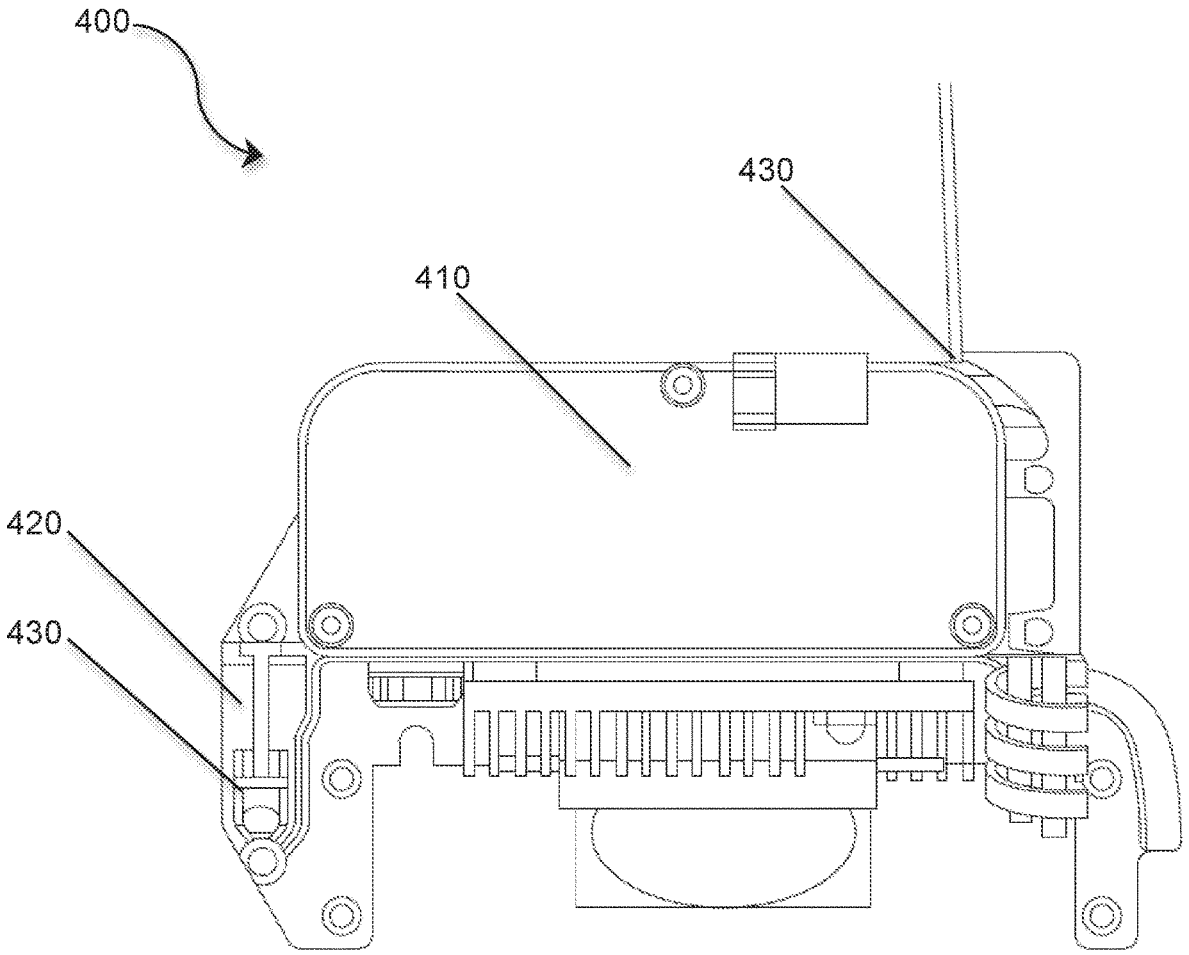
FIG. 3 illustrates a back view of an alignment module of the lighting system, in accordance with embodiments.
Figure 4:
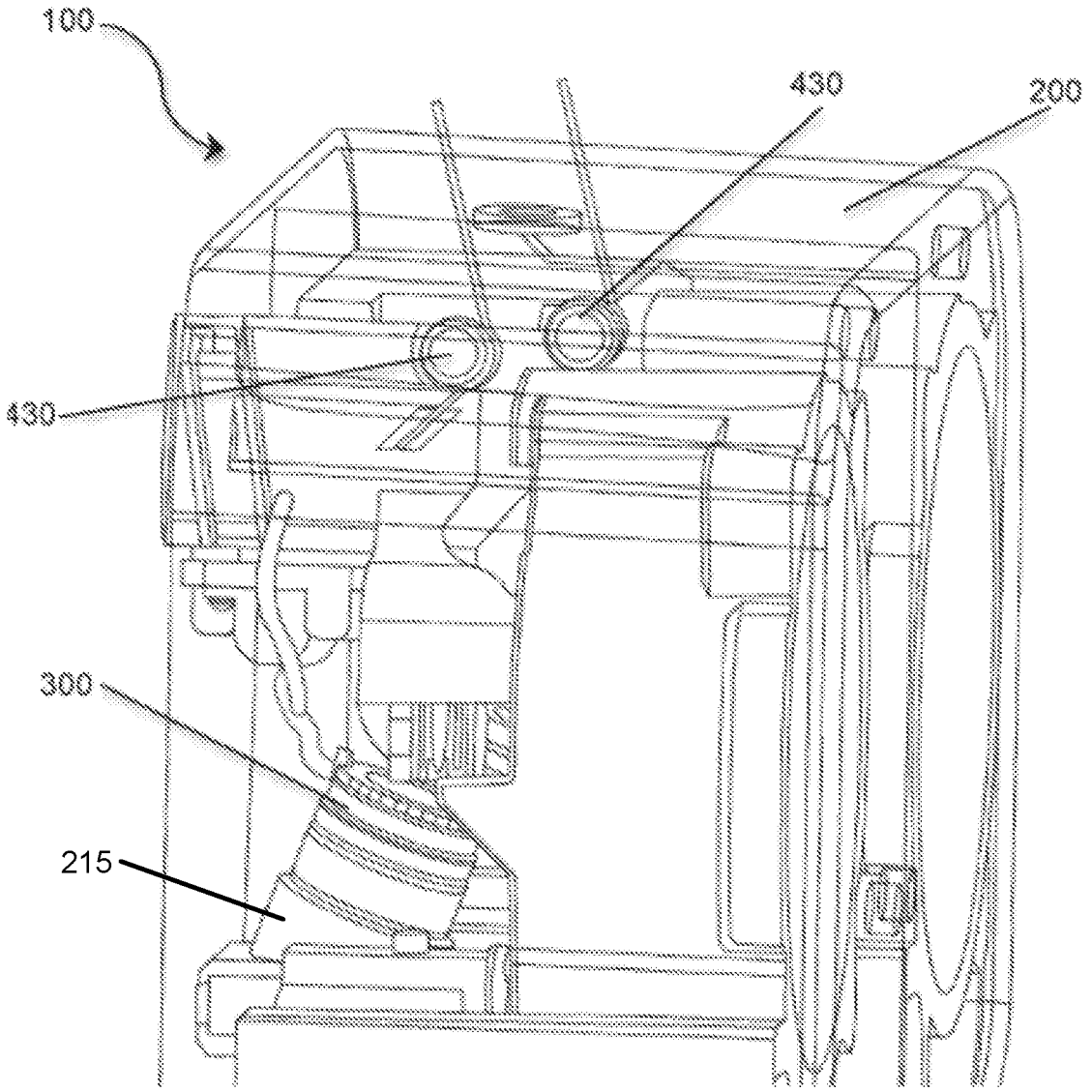
FIG. 4 illustrates a side view of a lighting system, in accordance with embodiments.
Figure 5:
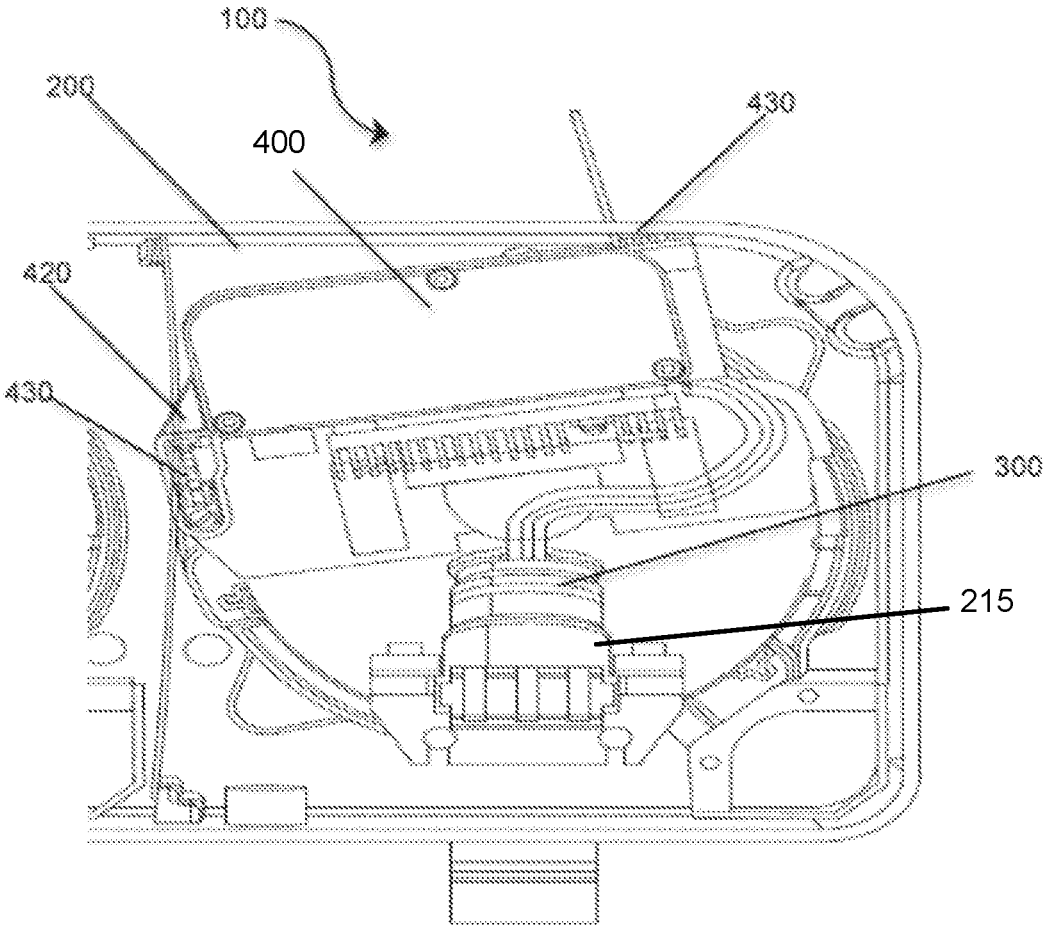
FIG. 5 illustrates a back view of a lighting system during a pivoting of the alignment module, in accordance with embodiments.

As illustrated in FIG. 3, the alignment module 400 permits the LED system 300 to be retrofitted into pre-existing incandescent housing 200. In this way, the alignment module 400 prevents pivoting or shifting of the reflector of the LED module of the LED system 300 within the housing 200 in the event outside forces causes rotation or movement of the housing 200. Consequently, the alignment module 400 serves to automatically align a focal point of the LED module during rotation, shifting, or movement of the housing 200. This may be done by preventing pivoting of the reflector of the LED module in the housing 200. In that way, the LED system 300 may be maintained, via the alignment module 400, in a static position in the housing 200. The overall optical performance of the LED system 300, therefore, is enhanced.

The alignment module 400 may be positioned in the interior space at a plurality of predetermined anchoring points A, B, C. Alternatively, the alignment module 400 may be, for example, rotatably positioned in the interior space at the predetermined anchoring points A, B, C. For example, the predetermined anchoring points may include a socket base 215 of the incandescent bulb, a first region, e.g., a pin, of the LED system 300, and a second region, e.g., the lens of the LED system 300.

In accordance with embodiments, the alignment module 400 may comprise a main body 410, an arm 420 that is to extend from the main body 410 to connect to the LED system 300, and at least one bias mechanism 430 to bias the alignment module 400 against at least one interior wall of the housing 200 during rotation or pivoting of the alignment module 400.

In accordance with embodiments, alternatively, the arm 420 may comprise a pivoting arm that permits that is to extend from the main body 410 to connect to the LED system 300, and at least one bias mechanism 430 to bias the alignment module 400 against at least one interior wall of the housing 200 during rotation or pivoting of the alignment module 400 about a pivot axis defined by the arm 420.

In accordance with embodiments, the alignment module 400 may comprise a main body 410 that is connected directly to the LED system 300, and at least one bias mechanism 430 to bias the alignment module 400 against at least one interior wall of the housing 200 during rotation or pivoting of the alignment module 400.

The main body 410 may be composed of one or more materials having dampening characteristics. Such materials may comprise elastomeric materials. The main body 410, while illustrated having a generally rectangular cross-section, may take any structural configuration that permits practice of embodiments set forth herein.

The pivot arm 420 may be composed of a material having dampening characteristics. Such a material may comprise an elastomeric material. The pivot arm 420 may be composed of the same material(s) as the main body 410. Alternatively, the pivot arm 420 may be composed of different material(s) than the main body 410. The main body 410 and pivot arm 420 may form a single, uniform structure. Alternatively, the pivot arm 420 may be mechanically connected to the main body 410.

Each bias mechanism 430 is to exert a biasing force against the surface of the interior wall. In accordance with embodiments, the bias mechanism 430 may comprise one or more springs placed at various regions of the alignment module 400. One such spring may be located at the pivot arm 420 while at least spring may be located on the main body 410. For example, the spring in the pivot arm 420 may comprise a plate spring, while the springs located on the main body 410 may comprise torsion springs or conical springs. Other types of springs may be used in a manner that permits practice of embodiments set forth herein.

ADDITIONAL NOTES AND EXAMPLES

Example 1 may include a lighting system, comprising: a housing defining an interior space; an LED system arranged in the interior space; and an alignment module supported in the housing to support the LED system in the interior space, dampen vibration of the LED system in the interior space, and automatically align a focal point of the LED system.

Example 2 may include the lighting system of Example 1, wherein the alignment module is arranged in the interior space at a plurality of predetermined anchoring points.

Example 3 may include the lighting system of Example 2, wherein the predetermined anchoring points comprise a socket base 215 of an incandescent bulb, a pin of the LED system, and a lens of the LED system.

Example 4 may include the lighting system of Example 1, wherein the alignment module comprises: a main body; a pivot arm extending from the main body, and which is connected to the LED system; and at least one bias mechanism to bias the alignment module against an interior wall of the housing during rotation thereof.

Example 5 may include the lighting system of Example 4, wherein the pivot arm defines a pivot axis about which the alignment module is to rotate in the housing.

Example 6 may include the lighting system of Example 4, wherein the pivot arm comprises the at least one bias mechanism.

Example 7 may include the lighting system of Example 6, wherein the at least one bias mechanism comprises spring.

Example 8 may include the lighting system of Example 6, wherein the main body is composed of a material having dampening characteristics.

Example 9 may include a system comprising: an LED lamp; and an alignment module supported to mount an LED lamp, dampen vibration of the LED system in the interior space, and automatically align a focal point of the LED system.

Example 10 may include the system of Example 9, wherein the alignment module is arranged in an interior space at a plurality of predetermined anchoring points.

Example 11 may include the system of Example 9, wherein the alignment module comprises: a main body; a pivot arm extending from the main body, and which is connected to the LED system; and at least one bias mechanism to bias the alignment body against a surface.

Example 12 may include the system of Example 11, wherein the pivot arm defines a pivot axis about which the alignment module is to rotate.

Example 13 may include the system of Example 11, wherein the pivot arm comprises the at least one bias mechanism.

Example 14 may include the system of Example 11, wherein the at least one bias mechanism comprises a spring.

Example 15 may include the system of Example 11, wherein the main body is composed of a material having dampening characteristics.

Example 16 may include method comprising: supporting an LED system in an interior space of a housing; and automatically aligning, during operation of the LED system, a focal point of the LED system during movement of the housing.

Example 17 may include the method of Example 16, wherein the LED system is mechanically supported in the interior space.

Example 18 may include the method of Example 16, further comprising dampening vibrations, during operation of the LED system, of the LED system in the interior space.

Example 19 may include the method of Example 16, wherein automatically aligning the focal point of the LED system comprises applying at least one bias force against at least one interior wall of the housing.

Example 20 may include the method of Example 16, wherein automatically aligning, during operation of the LED system comprises preventing pivoting of the LED system.

The term "coupled" may be used herein to refer to any type of relationship, direct or indirect, between the components in question, and may apply to electrical, mechanical, fluid, optical, electromagnetic, electromechanical or other connections. In addition, the terms "first", "second", etc. may be used herein only to facilitate discussion, and carry no particular temporal or chronological significance unless otherwise indicated.

As used in this application and in the claims, a list of items joined by the term "one or more of" or "at least one of" may mean any combination of the listed terms. For example, the phrases "one or more of A, B or C" may mean A; B; C; A and B; A and C; B and C; or A, B and C. In addition, a list of items joined by the term "and so forth", "and so on", or "etc." may mean any combination of the listed terms as well any combination with other terms.

Those skilled in the art will appreciate from the foregoing description that the broad techniques of the embodiments may be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

What is claimed is:

1. A lighting system, comprising:

a housing defining an interior space within the housing;

a LED system mounted in the interior space of the housing; and an alignment module positioned in the interior space of the housing to support the LED system at least at a base for an incandescent bulb, the alignment module being composed of a material having a dampening characteristic to dampen vibration of the LED system in the interior space, and connected to the LED system to maintain the LED system in a static position in the housing to automatically align a focal point of the LED system.

2. The lighting system of claim 1, wherein the LED system comprises at least one LED.

3. The lighting system of claim 1, wherein the alignment module comprises:

a main body;

a pivot arm extending from the main body, which is connected to the LED system; and at least one bias mechanism to bias the alignment module against an interior wall of the housing during rotation thereof.

4. A system, comprising:

a housing defining an interior space within the housing;

an LED lamp; and an alignment module positioned in the interior space of the housing to mount the LED lamp at least at a base for an incandescent bulb, the alignment module being composed of a material having a dampening characteristic to dampen vibration of the LED lamp in the interior space, and connected to the LED lamp to maintain the LED lamp in a static position in the housing to automatically align a focal point of the LED lamp.

5. The system of claim 4, wherein the alignment module comprises:

a main body;

a pivot arm extending from the main body, and which is connected to the LED lamp; and at least one bias mechanism to bias the alignment body against a surface.

6. The system of claim 5, wherein the pivot arm comprises the at least one bias mechanism.

7. The system of claim 5, wherein the at least one bias mechanism comprises a spring.

8. The lighting system of claim 3, wherein the pivot arm comprises the at least one bias mechanism.

9. The lighting system of claim 8, wherein the at least one bias mechanism comprises spring.

* * * * *